US008689683B2

(12) United States Patent
Actis

(10) Patent No.: US 8,689,683 B2
(45) Date of Patent: Apr. 8, 2014

(54) OPENING ASSEMBLY FOR PRESSING CHAMBERS

(75) Inventor: Bradley P. Actis, Clovis, CA (US)

(73) Assignee: H.W.J. Designs for Agribusiness, Inc., Clovis, CA (US)

( * ) Notice: Subject to any disclaimer, the term of this patent is extended or adjusted under 35 U.S.C. 154(b) by 235 days.

(21) Appl. No.: 13/035,526

(22) Filed: Feb. 25, 2011

(65) Prior Publication Data

US 2011/0209632 A1 Sep. 1, 2011

Related U.S. Application Data

(60) Provisional application No. 61/308,714, filed on Feb. 26, 2010.

(51) Int. Cl.
*B30B 15/16* (2006.01)

(52) U.S. Cl.
USPC .. 100/3; 100/7; 100/35; 100/179; 100/188 R; 100/240; 100/245

(58) Field of Classification Search
USPC ..... 100/3, 7, 35, 179, 188 R, 189, 240, 245
See application file for complete search history.

(56) References Cited

U.S. PATENT DOCUMENTS

| | | | | | |
|---|---|---|---|---|---|
| 3,691,945 | A * | 9/1972 | Guhl | 100/229 R |
| 3,795,084 | A * | 3/1974 | Richardson et al. | 53/502 |
| 4,002,115 | A * | 1/1977 | Nanoia | 100/343 |
| 4,136,610 | A * | 1/1979 | Tyler, Jr. | 100/100 |
| 4,391,186 | A * | 7/1983 | Davis | 100/7 |
| 4,550,657 | A * | 11/1985 | Van Doorn et al. | 100/43 |
| 4,788,901 | A * | 12/1988 | Klinner et al. | 100/188 R |
| 5,479,766 | A * | 1/1996 | Ransom | 56/341 |
| 6,536,197 | B1 * | 3/2003 | Covington et al. | 56/28 |
| 2005/0016394 | A1 * | 1/2005 | McDowell | 100/237 |
| 2008/0141873 | A1 * | 6/2008 | Gerngross et al. | 100/41 |

* cited by examiner

*Primary Examiner* — Shelley Self
*Assistant Examiner* — Onekki Jolly
(74) *Attorney, Agent, or Firm* — Klein, O'Neill & Singh, LLP

(57) ABSTRACT

A door opening assembly of a bale press including a first arm member having a first end and a second end hingedly coupled at the first end to a first door. The door opening assembly also includes a second arm member having a first end and a second end hingedly coupled at the first end to a second door. An actuator is coupled to the second end of the first arm member and the second end of the second arm member to cause the first arm member to displace the first door and the second arm member to hold the second door from being displaced. A further feature includes a door closing system involve a guide member and a guide receptacle for moving a latch gate to close the door.

20 Claims, 11 Drawing Sheets

OPENING ASSEMBLY FOR PRESSING CHAMBERS

CROSS-REFERENCE TO RELATED APPLICATION

This application claims the benefit of U.S. provisional Application No. 61/308.714, filed Feb. 26, 2010, the contents of which in their entireties are hereby incorporated by reference.

BACKGROUND

An opening assembly for a baling press having an acting pressure ram for producing compressed bales of fibrous material is generally discussed herein. More particularly, apparatus, systems, and methods are described having an improved door opening system for use with pivoting baling doors are discussed A standard double-box bale press typically includes a housing defining a vertically extending normally rectangular double box-section into which fibrous material to be baled is loaded. Although not always, the fibrous material is typically cotton. The bale press generally also includes a piston that travels vertically from an upper position to a lower position to press the loaded fibrous material in one box-section into a compacted bale. Normally, the housing is provided with a door for each box-section so that when the piston is in the upper position the doors can be opened to remove the compressed bale.

Historically, the doors of the standard double-box bale press have been operated manually by operators. This typically requires at least two operators be used to close the doors, guide the doors into a locked position, unlock and re-open the doors once the pressing operation is complete. Some baling presses of this type presents hazards to the operators in that the operators may be subject to injury, for example, when the high compression forces inadvertently "kick" the door open as the operator is attempting to open the door.

SUMMARY

The various embodiments of the present bale press, opening, and closing assemblies and related methods have several features, no single one of which is solely responsible for their desirable attributes. Without limiting the scope of the present embodiments as expressed by the claims that follow, their more prominent features now will be discussed briefly. After considering this discussion, and particularly after reading the section entitled "Detailed Description," one will understand how the features of the present embodiments provide advantages, which include the capability of opening doors to a housing of a bale press.

A door opening assembly for a bale press comprising a first arm member having a first end, a second end, and hingedly coupled at the first end to a first door and a second arm member having a first end, a second end, and hingedly coupled at the first end to a second door is provided. An actuator is coupled, either directly or indirectly, to the second end of the first arm member and the second end of the second arm member, and wherein activation of the actuator causes at least one of the first arm member and the second arm member to pivot.

Further in accordance with the present device, assembly, and method, the actuator coupled to a bale press to facilitate the automatic displacement of the first door.

The actuator can be connected to a cross member, which is connected to the first arm member and the second arm member. Pivot pins may also be connected to the cross member and the first and second arm members so that the cross member is pivotably connected to the first arm member and the second arm member.

The actuator can so be pivotably connected to the bale press.

The first arm member can be made from a first beam and a second beam and wherein the first beam and the second beam are spaced from one another.

A further feature of the present device, system, and method include a bale press having a movable piston that travels from an upper position to a lower position to press fibrous material into a compressed bale. The bale press can further include a housing defining a double box-section, having a first box and a second box and a first door for the first box and a second door for the second box. A door opening assembly can be incorporated comprising a first arm member having a first end, a second end, and hingedly coupled at the first end to the first door and a second arm member having a first end, a second end, and hingedly coupled at the first end to the second door. The door opening assembly can further include an actuator coupled, directly or indirectly, to the second end of the first arm member and the second end of the second arm member, and wherein activation of the actuator causes the first arm member to displace the first door or the second arm member to displace the second door.

The actuator can be connected to a cross member, which is connected to the first arm member and the second arm member. In another example, the cross member is pivotably connected to the first arm member and the second arm member. In yet another example, the actuator is pivotably connected to the housing.

The present application further includes a method for opening doors to a bale press having housing with a first door and a second door. The method comprising connecting a first arm member to the first door, the first arm member having a first end, a second end, and being hingedly coupled at the first end to the first door. Connecting a second arm member to the second door, the second arm member having a first end, a second end, and being hingedly coupled at the first end to the second door. The method further includes the steps of connecting an actuator, either directly or indirectly, to the second end of the first arm member and the second end of the second arm member and either directly or indirectly to the housing, and actuating the actuator to lengthen a rod and causing the first arm member or the second arm member to pivot relative to the actuator.

Other aspects and variations of the door opening assembly summarized above are also contemplated and are more fully understood when considered with respect to the following disclosure.

DETAILED DESCRIPTION

The detailed description set forth below in connection with the appended drawings is intended as a description of embodiments of the door opening assembly provided in accordance with aspects of the present apparatus, systems, and methods and is not intended to represent the only forms in which the present apparatus, systems, and methods may be constructed or used. The description sets forth the features and the steps for using the door opening assembly of the present disclosure in connection with the illustrated embodiments. It is to be understood, however, that the same or equivalent functions and structures may be accomplished by different embodiments that are also intended to be encompassed within the spirit and scope of the apparatus, systems, and methods. As denoted elsewhere herein, like element numbers are intended to indicate like or similar elements or features.

Figure 1:
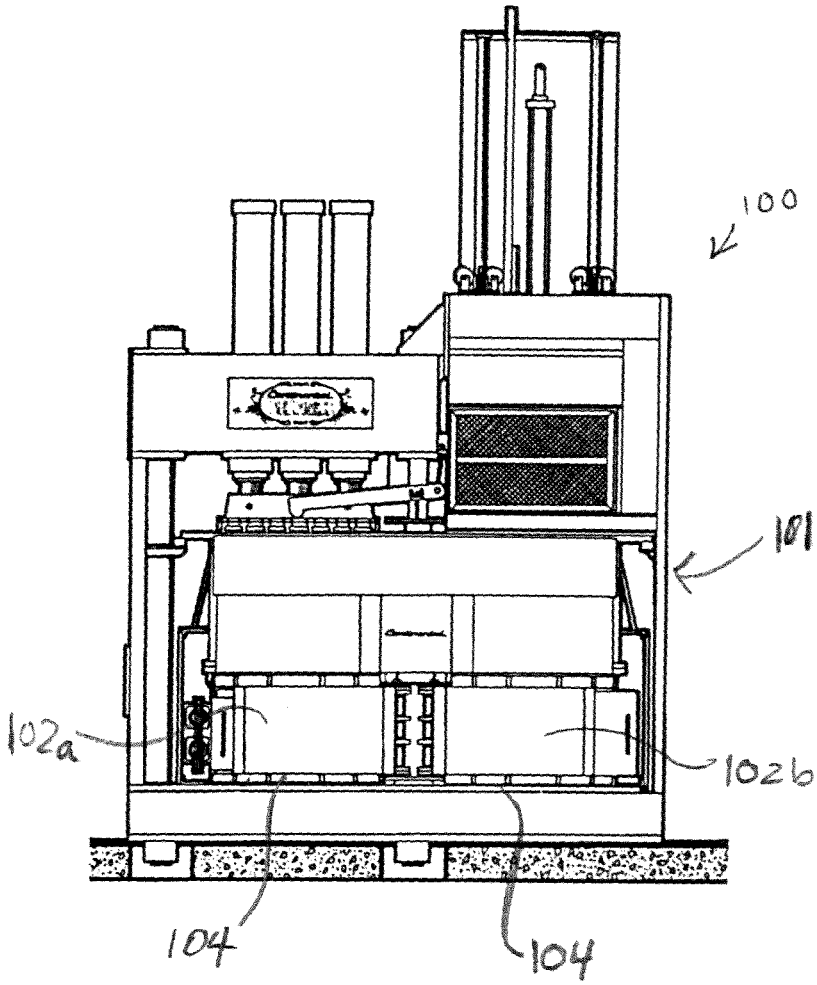
FIG. 1 is a front view of a cotton bale press.

Aspects of the present disclosure include improvements to existing baling presses, which are well known in the industry. FIG. 1 is a front view of a typical cotton bale press 100, which provides a context in which the present apparatus, systems, and methods operate. The cotton bale press 100 is a double box baling press. Each box (also referred to as pressing chambers) is defined by a set of doors, which include doors 102*a* for one set of box and doors 102*b* for a second set of box. However, only one door for each of the first box and second box are shown on the first side 101. In operation, fiber is fed into one box at a time by a pusher assembly while the other box undergoes a pressing cycle. A hydraulic tamper is used to pack the fiber into the pressing chamber until a predetermined amount of fiber is packed. The boxes then rotate 180 degrees and the pressed fiber is then pressed into a bale while the previously pressed fiber is offloaded and new fiber loaded for pressing. When one or both of the doors 102*a* and 102*b* are opened, one or both of the other doors on the opposing second side of the bale press are also allowed to open for removal of the bale. The cycle repeats with the boxes rotating between being filled with fiber and the fiber being pressed. A more detailed description of the first and second doors as they relate to the present disclosure is provided below. Typically, the bottom walls of both chambers are provided with a series of parallel, aligned slots 104 for the purpose of passing baling wire around compacted bales in the chambers, as understood in the art.

An exemplary baling press, such as the baling press 100 shown in FIG. 1, is available from Continental Eagle Corporation of Prattville, Ala., known commercially as the Bespress Universal Density Press. It should be understood, however, that the improvements to be described below may be embodied in other existing double-box baling press.

The operation steps of the doors of the baling press 100 are now described with reference to FIGS. 2A, 2B and 2C. In this example, reference is made primarily to only one box and one set of opposed doors of the cotton bale press 100. However, it should be understood that the components and operations to be described are applicable to the second box and the other set of doors as well.

Figure 2A:
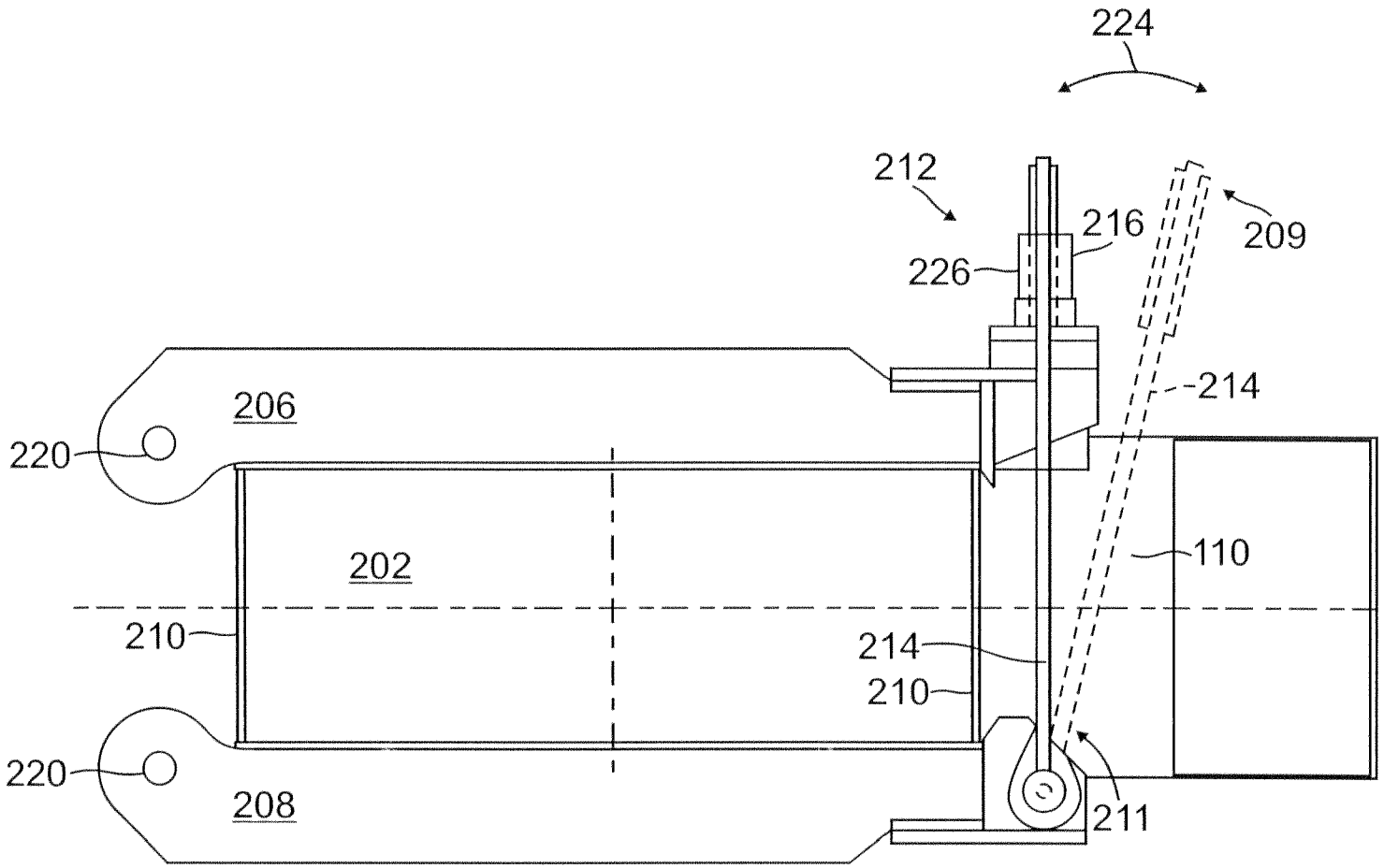
FIG. 2A is a simplified top view of the front opening and the rear opening doors on the cotton bale press of FIG. 1.

Refer initially to FIG. 2A, the cotton bale press 100 includes a first box 202 defined by side walls 210 and by "front opening" door 206 and "rear opening" door 208 that are positioned on opposed sides of the first box 202. The designations "front opening" and "rear opening" are used only to distinguish the direction of travel of the doors relative to one another and are not meant to be otherwise limiting. When the front opening door 206 is opened, the rear opening door 208 is also allowed to open after the pressing has stopped to allow strapping of the pressed material and then removal of the compacted bale formed in the first box 202. The pressing of the fibrous material is in the vertical plane and once the bale has been formed by pressure on one axis, it only wants to expand for the most part, back in that axis.

Figure 2B:
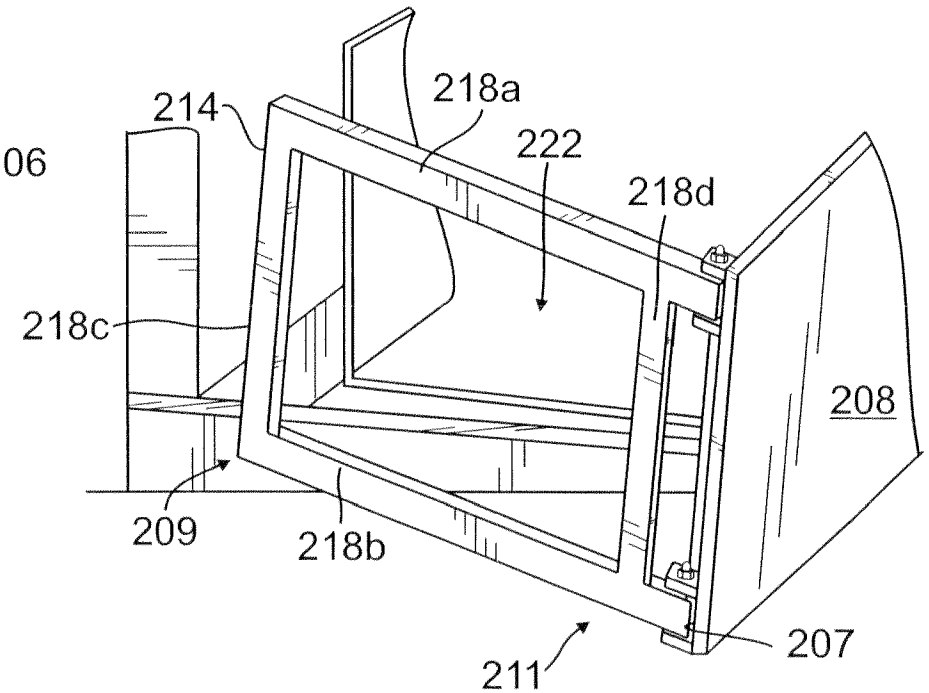
FIG. 2B is a simplified perspective view showing a latch gate coupled to the rear opening door on the cotton bale press of FIG. 1.
Figure 2C:
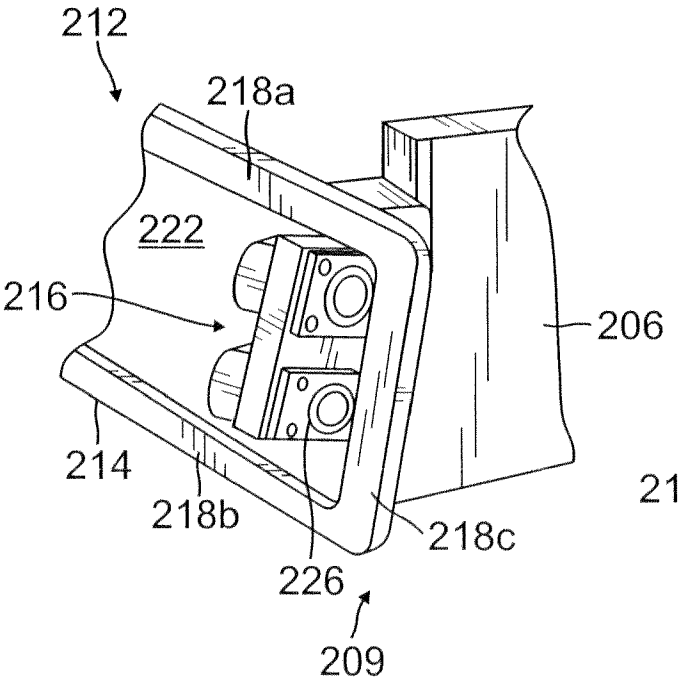
FIG. 2C is a simplified perspective view showing a locking mechanism for use with the front opening and rear opening doors on the cotton bale press of FIG. 1.

With reference to FIGS. 2A, 2B and 2C, each set of doors includes a locking mechanism 212, which includes a latch gate 214 and a set of stacked hydraulic rams 216. As described in detail below, the stacked hydraulic rams 216 are made to press against the latch gate 214 to hold the front and rear opening doors 206, 208 in a locked position. In the embodiments described below, it is presumed that the front opening door 206 has the stacked hydraulic rams 216 positioned thereon or in association therewith while the rear opening door has the latch gate 214 mounted thereon or in association therewith. In short, the latch gate 214 provides a connecting means, like a loop or a knot, between the front and rear opening doors 206, 208 while the hydraulic rams 216 are used to take up the slack of the connecting means to thereby press the front and rear doors together with the sidewalls 210 disposed therebetween.

As shown in FIG. 2B, the latch gate 214 is an open frame gate having a horizontally extending top rail 218*a* and a horizontally extending bottom rail 218*b*. The top and bottom rails 218*a* and 218*b* are connected together at a first end 209, which has a vertically extending front rail 218*c*, and at a second end 211 on the opposite side from front rail 218*c*, which has a vertically extending back rail 218*d*. At the second end 211, the latch gate 214 is hingedly coupled to and extends perpendicularly from the rear opening door 208 via rotatable hinges 207. The open framed latch gate 214 defines an open space 222 bounded by the top rail 218*a*, the bottom rail 218*b*, the front rail 218*c* and the back rail 218*d*.

As shown in FIG. 2C, the hydraulic rams 216 are stacked vertically relative to one another and extend horizontally relative to the planar surface of the front door 206 on its external side, on the non-hinged end of the front opening door 206. Operationally, as shown in FIG. 2B, as the front opening door 206 and the rear opening door 208 are moved to a closed position, the latch gate 214 is manually guided externally around the side wall 210. The latch gate 214 is pushed through an opening in the bale press toward the stacked hydraulic rams 216, as is well known in the art for closing the pressed chamber.

As shown in FIG. 2A, when the front and rear opening doors 206 and 208 are to be closed against the sidewalls 210 to form an enclosed pressed chamber, the latch gate 214 moves from a rotated position (shown in phantom) to an aligned position over the hydraulic rams 216. Movement of the latch gate 214 in the direction of the arrow 224 may be done manually, which causes the latch gate 214 to move toward the hydraulic rams to encompass or capture the hydraulic rams 216 within the open space 222. As shown in FIG. 2C, manual movement of the latch gate 214 causes the front rail 218*c* to become aligned with the pistons 226 of the hydraulic rams 216. Once in this aligned position, the hydraulic rams 216 are activated causing the pistons 226 to extend and press against the front rail 218*c* of latch gate 214. By pressing the latch gate 214 with the hydraulic rams, the front and rear opening doors 206 and 208 are "pulled" together to become "locked" around the first box 202. To "unlock" the doors, the pistons 226 are first de-energized or de-activated and the latch gate 214 rotated to disengage from the hydraulic rams 216. The latch gate 214 moves out away from the hydraulic rams 216 in the direction of the arrow 224. The front opening door 206 and the rear opening door 208 are now free to swing about their hinged ends 220 (FIG. 2A).

Figure 3:
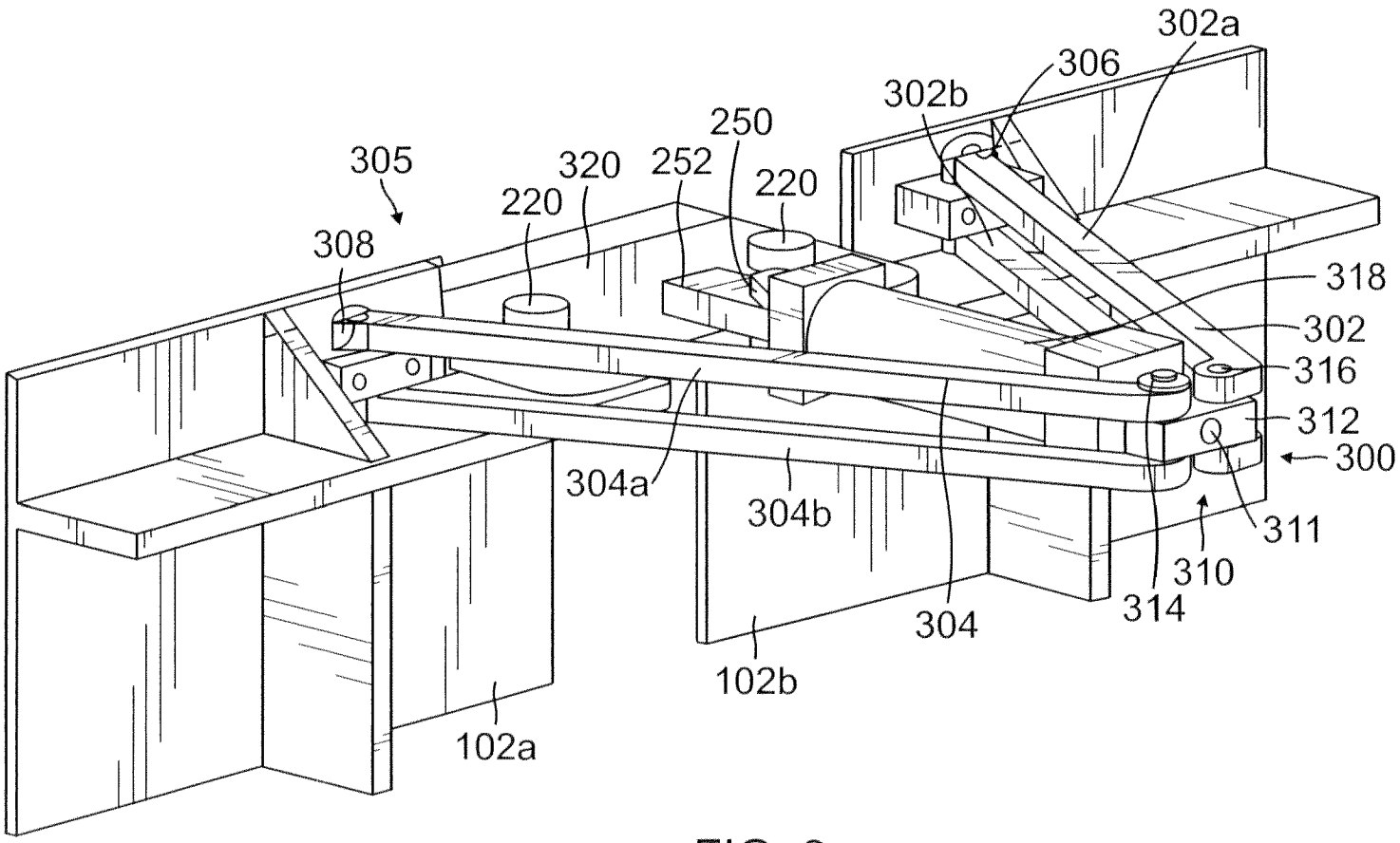
FIG. 3 is a simplified perspective view of a door opening assembly in accordance with an embodiment of the present disclosure.

FIG. 3 is a simplified illustration of a door opening assembly 300 provided in accordance with the present methods, and systems. The door opening assembly 300 may be coupled to the bale press 100 to facilitate the automatic opening of the side-by-side front doors 102*a* and 102*b* of the bale press, which are similar to the doors 206, 208 discussed with reference to FIGS. 2A-2B.

In one embodiment, the door opening assembly 300 is formed as a triangularly shaped frame having a first arm 302 and a second arm 304. The arms 302 and 304 may embody any suitable structural member, such as a solid bar, a hollow cylinder, and the like, that provide significant strength and stiffness to be able to withstand the forces required to open and close the doors. In one example, the arms 302, 304 of the door opening assembly 300 resemble a linkage in which the arms are connected, either directly or indirectly, to the two doors to manipulate the doors, as further discussed below.

In this embodiment, the arms 302, 304 are each made of two parallel extending beams, for example beams 302*a*, 302*b* for arm 302 and beams 304*a* and 304*b* for arm 304. A first end 305 of the first arm 302 and a first end 305 of the second arm 304 are rotatably coupled to the doors by means of hinges 306 and 308, respectively. Although, hinges 306 and 308 may be any hinges suitable for rotatably coupling the arms to the doors, in this embodiment, the hinges 306 and 308 are formed as journal bearings, coupling together the parallel extending beams 302*a*, 302*b*. 304*a* and 304*b* of the arms, via respective pins or similar structures, to the respective doors 102*a*. 102*b*.

If the doors define generally vertical planar surfaces, one of each of the arms extend horizontally out from each door and the two are made to meet at a center point 310, which forms the apex of the triangularly shaped frame. The positioning of the hinges 306, 308 on the doors and thus the angle of extension of the arms 302 and 304 and their length may vary. In one example, the lengths are determined by optimizing the mechanical advantage provided by the positioning of the hinges 306 and 308 relative to the actuator 318, as further described below. At the center point 310, the arms 302, 304 are rotatably coupled to a cross member 312 by means of hinges 314, 316. Although, the hinges 314, 316 may embody any hinge suitable for rotatably coupling the arms to the cross member 312, in one example the hinges 314, 316 are formed as journal bearings. The journal bearings, such as pins located inside respective sleeves or sockets, couple the parallel extending beams 302*a*/302*b* and 304*a*/304*b* of the arms to the cross member 312.

The door opening assembly 300 also includes an actuator 318, which may be a pneumatic cylinder or a hydraulic cylinder having a telescoping rod or shaft. The actuator 318 is coupled to the cross member 312. In one example, the rod of the actuator is connected to the cross member 312 at a centerline of the cross member to bisect the apex of the frame formed by arms the two arms 302, 304 and the base formed by portions of the two doors. As shown, the telescoping rod connects to the cross member 312 through a center boss 311. The actuator 318 is rotatably coupled, directly or indirectly, to the bale press 100 by way of a hinge 250 located on a tab 252. The hinge 250 to which the actuator 318 is connected to is located adjacent to two other hinges 220, which are means by which the doors 102*a*, 102*b* rotate. In one embodiment, the tab 252 is connected to an actuator support member 320, which may embody a metal block added and secured to the bale press 100 between the two doors to support the actuator 318. In other embodiments, the tab 252 is welded or fastened directly to the existing frame structure of the bale press 100.

Figure 4:
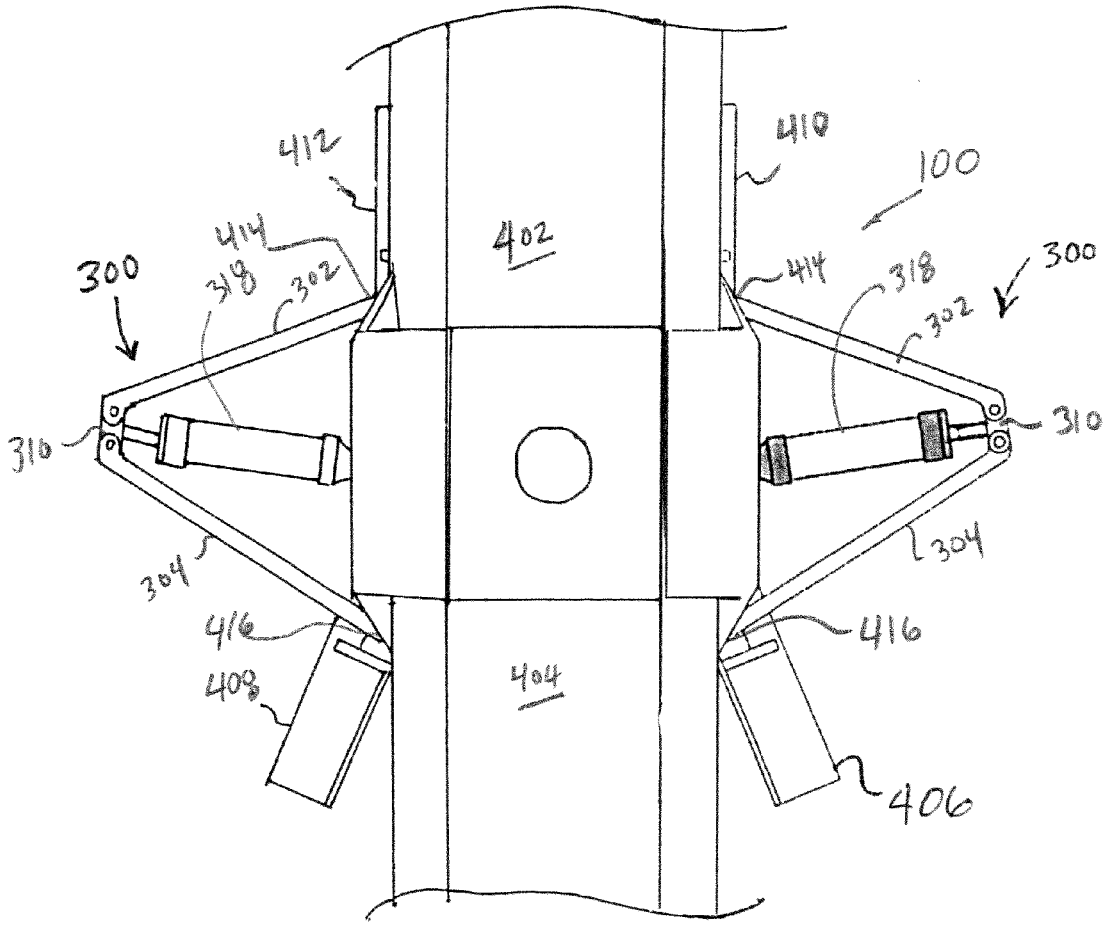
FIG. 4 is a simplified top view of the operation of the door opening assembly of FIG. 3 in accordance with an embodiment of the present disclosure.

FIG. 4 is a simplified top view illustrating the operation of the door opening assembly 300, as used to automatically open the front and rear opening doors of the cotton bale press 100 so that a compressed bale may be removed one at a time from the boxes. For reference purposes, the doors have been relabeled as 406, 408, 410, and 412. Once fibrous material has been compressed into a bale to strap and remove the bale from, for example the second box 404, the locking mechanism 212 is disengaged in the manner discussed above. The pistons 226 of the hydraulic rams 216 are retracted and the latch gate 214 is released and moved away from the hydraulic rams 216 (see FIGS. 2A, 2B, 2C). Typically in a dual-box bale press, one box is used to compress a stack of fibrous material while the other box is used to load new fibrous material to be compressed. Thus, as an example, no bale is to be removed from the first box 402 while compressed bale is being strapped and removed from the second box 404. Thus, the front opening door 410 and the rear opening door 412 for the first box 402 remain closed and locked during bale removal.

Since the doors 410, 412 for the first box 402 remain locked during bale removal of the second box 404, the points at which the first arms 302 are hinged to the locked doors do not move during bale removal and may be considered "fixed" or non-displaced points of contacts 414 relative to the door hinges 220 (FIG. 2A). Conversely, the set of doors 406 and 408 for the second box 404 are unlocked during bale removal and thus are free to swing about their respective hinges 220. Thus, the points at which the second arms 304 are hinged to the doors are "non-fixed" or displaceable points of contacts 416 relative to hinges 220.

Referring again to FIG. 4, activation of the two actuators 318 causes them to lengthen. Since the actuators 318 are coupled to the arms at the apex of the frame (center point 310), one or the other arms, i.e., 302 or 304, must move to accommodate the lengthening actuators. As shown, the first box 402 is closed and the first arms 302 are coupled to the doors 410, 412 at hinged fixed points 414. Since the second box 404 is opened and the second arms 304 are coupled to the doors 406, 408 at displaceable points 416, the lengthening actuators 318 cause the center points 310 to rotate about the hinged fixed points 414 to accommodate the new lengths. The rotation of the center points 310 forces the second arms 304 to "pull" on the doors 406, 408 at the hinged displaceable points 416. Because the doors are hingedly coupled to the second arms 304 at the displaceable points 416, the pulling action causes the doors to be displaced or rotated about their common hinges 220 (FIG. 2A) and swing open.

Figure 4A:
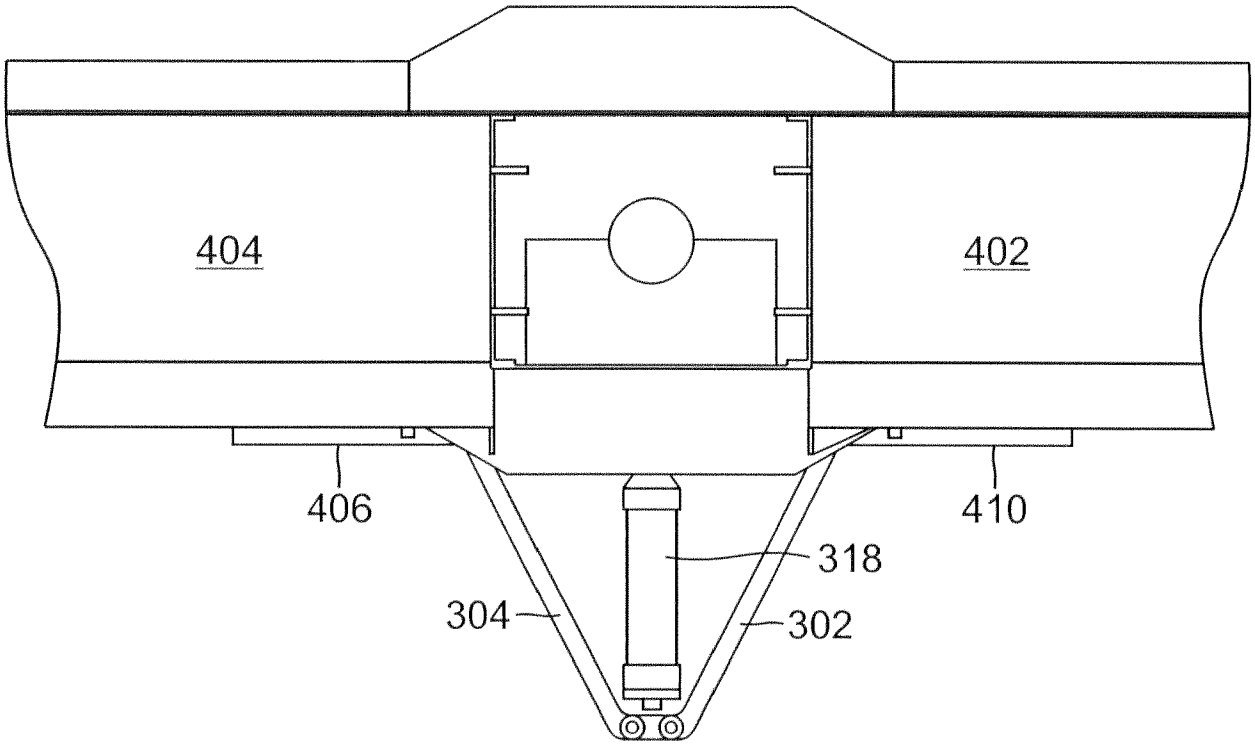
FIG. 4A is a simplified top view of the door opening assembly of FIG. 3 in which both doors are in the closed position.

From a door open position, de-activation of the actuators 318 causes the actuators to retract or shorten, forcing the first arms 304 and thus the center points 310 to rotate about the hinged fixed points 414 back to their door closed positions. The rotation of the center points 310 forces the second arms 304 to "push" on the doors 406, 408 at the displaceable points 416. Because the doors are hingedly coupled to the second arms 304 at the moveable points 416, the pushing action causes the doors to be displaced or rotated about their common hinges 220 and swing closed. FIG. 4A shows both doors in their respective closed position.

Thus, a feature of the present apparatus, systems, and methods include a door opening assembly comprising two sets of arms each connected to a respective door of a bale press and wherein the two sets of arms are connected to a common cross member. A further feature is an actuator for moving the first set of arms or the second set of arms by pushing on the common cross member. A still further feature is a door opening assembly having two set of arms each connected to a respective door of a bale press and wherein the two arms and a section of the bale press from a triangular shaped linkage assembly when viewed from the top. Yet, a still further feature of the present methods is the actuation of an actuator to push against a cross member to open one of two doors, and wherein a particular door that opens is controlled by locking the other door.

One example of the door opening assembly is a linkage system comprising an actuator and two sets of arms each connected to a door of a bale press. The assembly comprises a plurality of hinges, such as more than two hinges, for example five hinges. In one specific example, each of the two arms is connected to two hinges and the actuator to a single hinge. The actuator may be a pneumatic actuator or a hydraulic actuator. Each arm may comprise a pair of elongated rods are bars.

The speed and the extent that the actuators 318 move when actuated may be controlled. Thus, the speed at which the doors open and the amount that they are allowed to open are also controllable.

Figure 5:
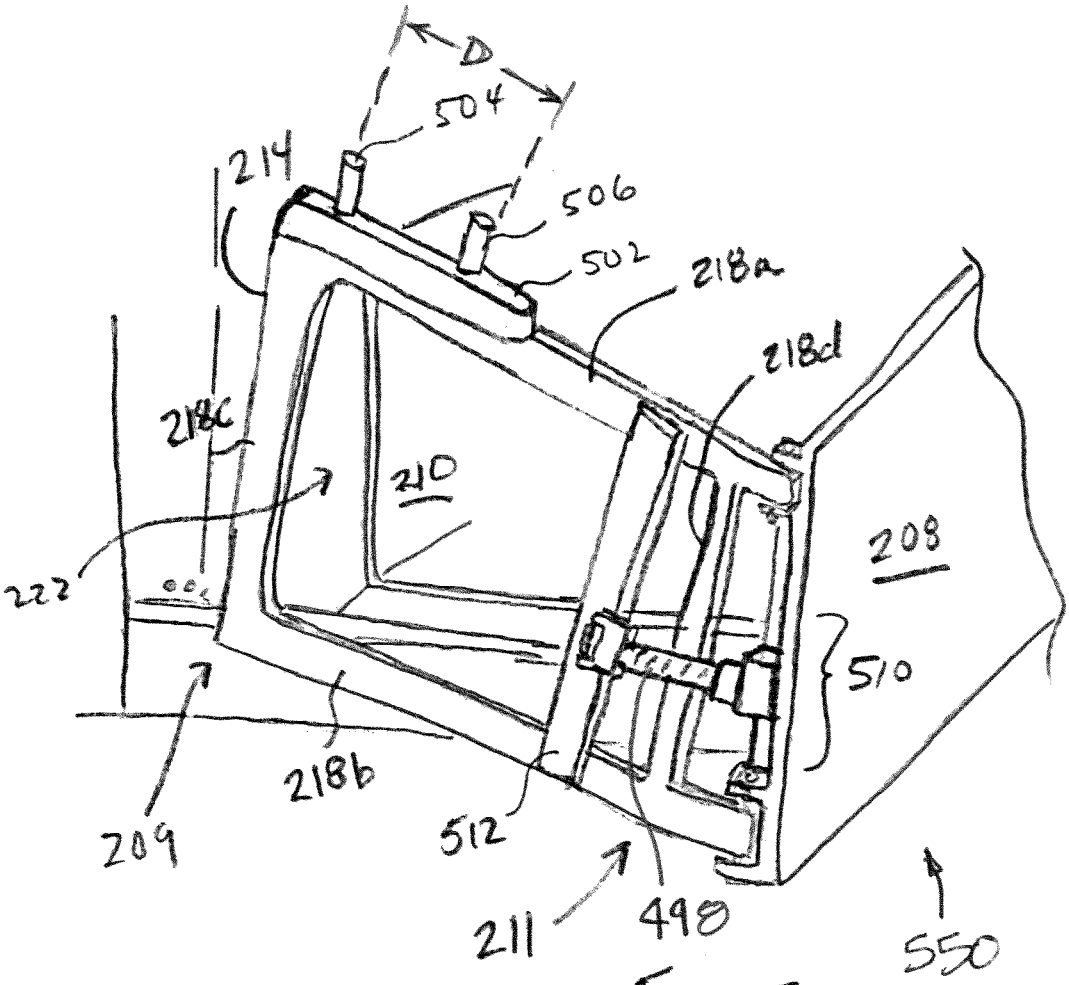
FIG. 5 is a simplified perspective view showing the latch gate coupled to the rear opening door on the cotton bale press of FIG. 1 including novel modifications in accordance with an embodiment of the present disclosure.

FIG. 5 is a simplified illustration showing an automated closing assembly 550 of the front and rear opening doors 206, 208. The latch gate 214 of the automated closing assembly 550 is capable traversing through the bale press 100 and be appropriately aligned with the hydraulic rams 216 for locking the doors. In one example, a door guide 502 and an actuation device 510 are incorporated to move and align the latch gate 214. The door guide 502 is positioned adjacent a top portion of the top rail 218*a* proximate the first end 209 of the latch gate 214. The door guide 502 may be attached to the latch gate 214 by welding or bolting the door guide 502 to the top rail 218*a* or by any other means currently practiced in the attachment art. In one embodiment, the door guide 502 includes a first guide member 504 and a second guide member 506 that extend vertically from the door guide 502 and perpendicular to the top rail 218*a*. In one embodiment, the first guide member 504 is positioned in-line with the second guide member 506 on the door guide 502 but closer to the first end 209 of the latch gate 214. The first guide member 504 is also spaced part from the second guide member 506 by a distance D. In one embodiment, first and second guide members 504 and 506 are cylindrical posts that extend vertically above the latch gate 214 and are rotatably coupled to the door guide 502. Being rotatable cylinders allows the posts to contact and traverse against a surface, such as against a closing channel or guide receptacle, with reduced friction, as further discussed below.

It should be understood that the first and second guide members 504 and 506 may take the form of any friction reducing guide members, such as a sleeve mounted over rolling ball hearings, over cylindrical bearings, and over sleeve bearings and the like. In one alternative embodiment, the first guide member 504 and the second guide member 506 may be attached directly to the top rail 218*a* without the door guide 502, such as by welding or bolting the guide members thereto. In one specific example, a door guide comprises a solid core or rod, a bearing, and an outer sleeve. The sleeve is rotatable relative to the solid core, which is fixed to either the top rail 218*a* or to the door guide 502.

Referring again to FIG. 5, the actuation device 510 is mounted at the second end 211 of latch gate 214. The actuation device is spring loaded to hold the latch gate 214 in the full 'in' position when no other forces are exerted on latch gate 214, except the force of wanting to swing 'out' while the door 208 is being moved open or closed. An actuation support member 512 may be mounted to the latch gate 214, for example extending vertically between the top rail 218*a* and the bottom rail 218*b*, to support a first end of the actuation device 510 while the second end of the actuation device is coupled to the rear opening door 208. In one embodiment, the actuation device 510 is a heavy duty spring used to force the latch gate 214 into a desired aligned position, such as with the hydraulic rams 216 as described in detail below. For example, the latch gate 214 may be rotated about its hinges due to various means, such as by an actuating cylinder, a motor, a pulley system, etc., and the spring is configured to rotate the latch gate 214 back to its normal position when the force is removed, as further discussed below. Alternatively, the actuation device 510 may be a pneumatic, hydraulic or electromechanical actuator capable of forcing the latch gate 214 to the in position.

Figure 6A:
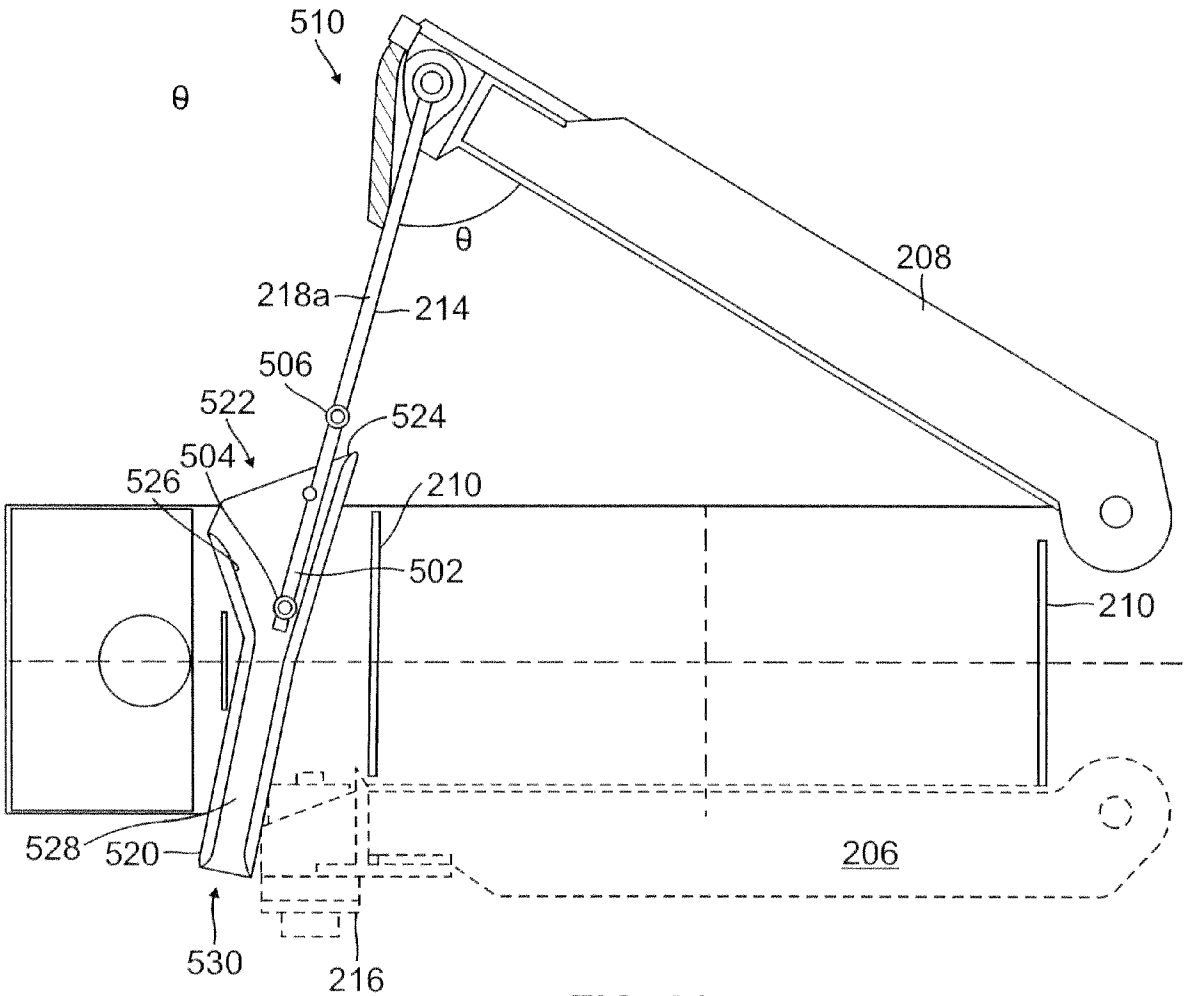
FIGS. 6A and 6B are simplified top views of a door guide and an actuation mechanism as used in conjunction with the cotton bale press of FIG. 1 in accordance with an embodiment of the present disclosure.
Figure 6B:
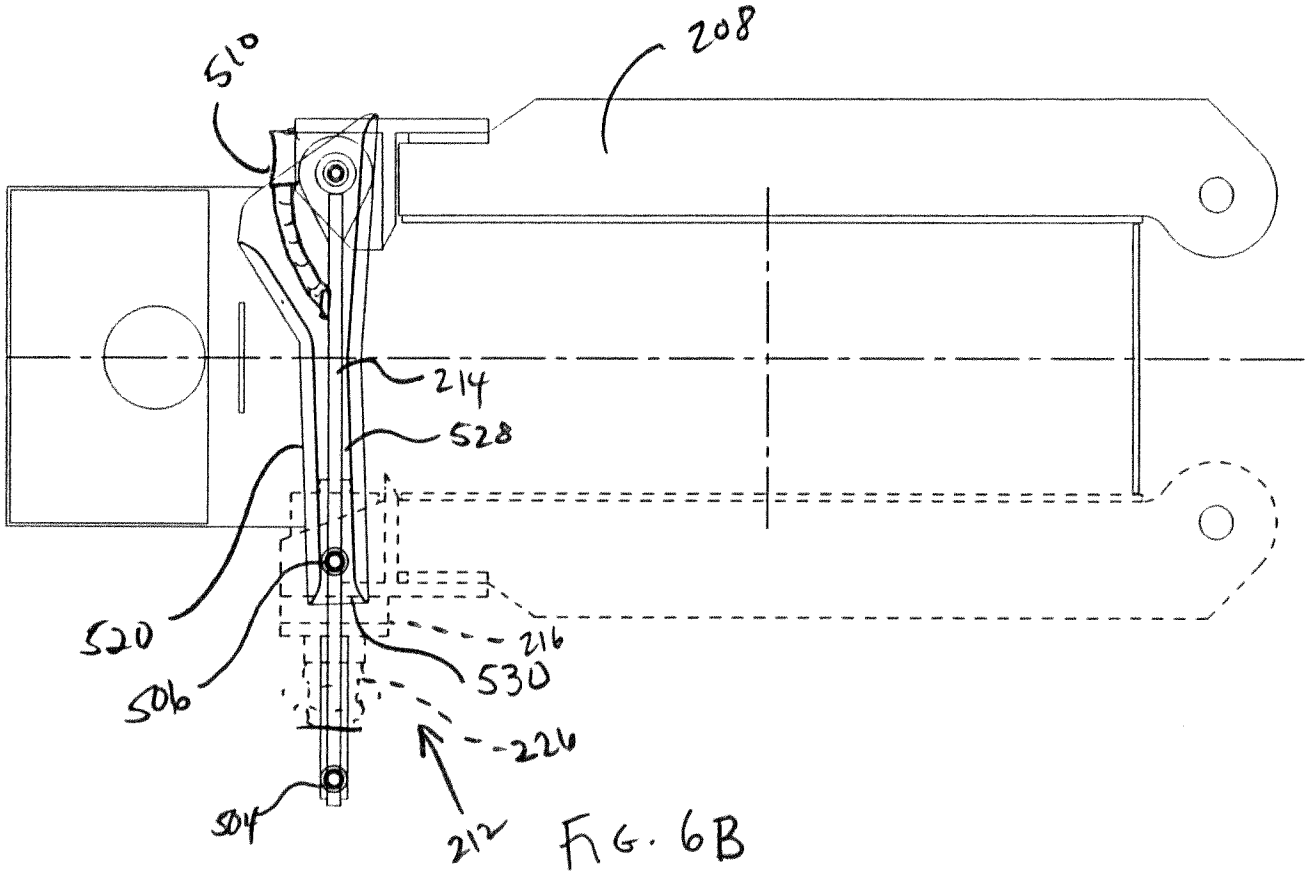

FIGS. 6A and 6B are simplified illustrations showing a guide receptacle 520 configured to receive the door guide 502 and the guide members 504 and 506. In one embodiment, the guide receptacle 520 is mounted on the bale press 100 adjacent and external to side wall 210 of the pressing chamber. The guide receptacle 520 includes an ingress portion 522, which is sized, shaped and configured to receive and capture the guide members 504, 506 mounted to the top of top rail 218*a* as the rear opening door 208 is made to close. As shown, the guide receptacle is mounted to guide the guide members only and not the latch gate 214. As such, the size and physical features of the guide receptacle 520 are limited to the guide members 504, 506 and not the entire latch gate. In another embodiment, the guide receptacle is configured to guide at least part of the latch gate. The ingress portion 522 is defined by a straight surface 524 on one side and an angled surface 526 on the other. Surface 526 is makes the egress point a funnel to capture the guide members 504, 506 in the case that rapid motion of door 208 should cause the weight of latch gate 214 to overcome the actuation device 510 slightly. The two surfaces form an enlarged inlet resembling a funnel. The latch gate 214, being hinged to the door 208, is free to vary in angle θ relative to the rear opening door 208 as the guide members 504, 506 are forced to traverse through the guide receptacle 520. This allows the latch gate 214 to be guided though the press while the door 208 and 206 are closing or opening without striking any blocking structures or binding or jamming. In other words, in pushing the latch gate 204 through the press pathway 503 so that it could be moved over the hydraulic ram 216 (FIG. 2C), the path of the latch gate 204 is controlled by the manner in which the guide members 504, 506 are confined within the channel of the guide receptacle 520. During portions of the travel, the latch gate 204 is forced to pivot about their hinges, i.e., "bend around", due to the physical constraint provided by the guide receptacle 520. In the event that the latch gate 214 is traversing at an angle θ greater than necessary relative to the rear opening door 208, the first guide member 504 may contact the angled surface 526 upon entering the ingress portion 522. The angled surface 526 directs the first guide member 504 in the desired direction through the receptacle guide 520.

Figure 6C:
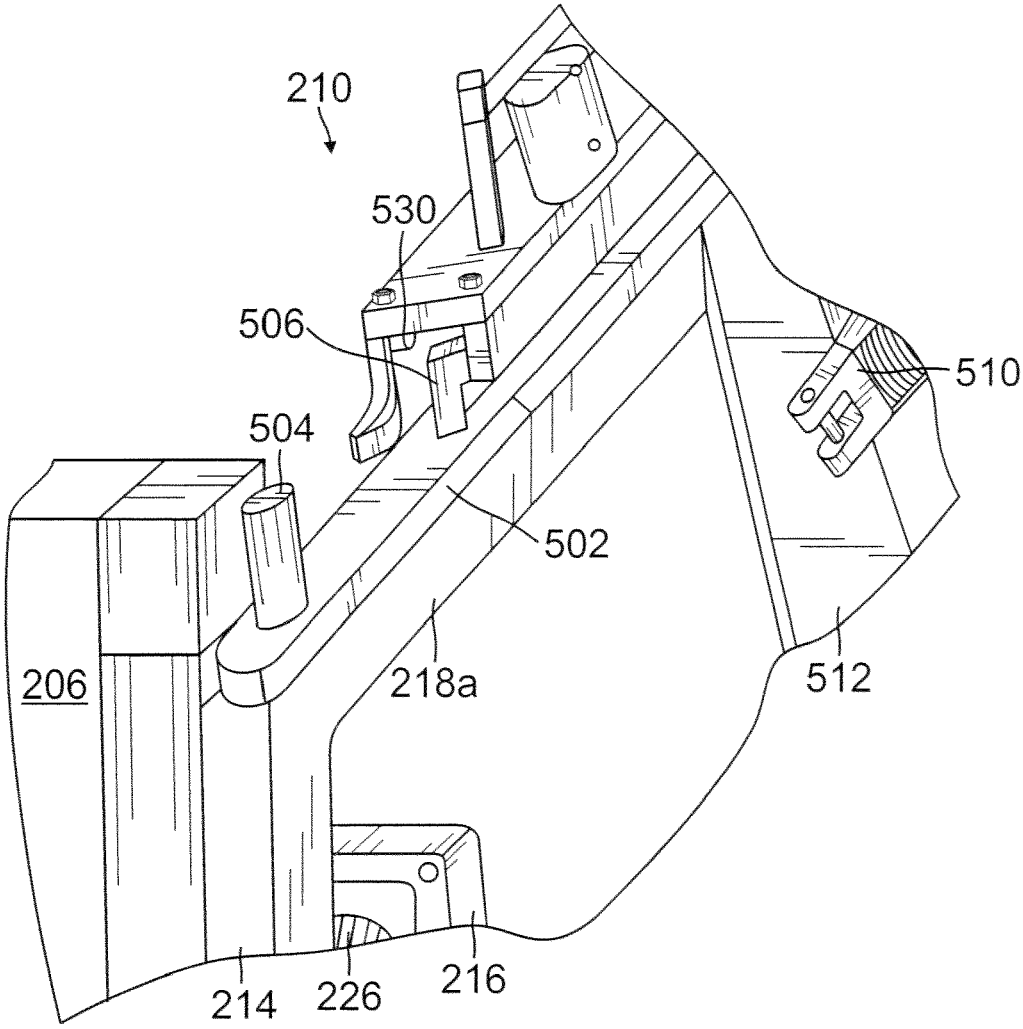
FIG. 6C is a perspective view of the egress portion of the receptacle guide and guide members in accordance with an embodiment of the present disclosure.

As the guide members 504 and 506 are made to enter into the guide receptacle 520, the ingress portion 522 delivers the guide members 504 and 506 into a narrow channel 528. The narrow channel 528 continues to extend through the bale press 100 until it extends out proximate to the hydraulic rams 216 where the narrow channel 528 terminates at an egress portion 530. With continued reference to FIGS. 6A and 6B, and now with reference to FIG. 6C, the guide members 504 and 506 continue through the narrow channel 528 until the rear opening door 208 is fully closed. As previously mentioned, the first guide member 504 and second guide member 506 are spaced apart by a distance D, the distance D being selected to allow the first guide member 504 to exit the egress portion 530 while the second guide member 506 remains captured within the guide receptacle 520 when the rear opening door 208 is in the fully closed position.

The guide members 504 and 506 having traversed through the narrow channel 528 and the latch gate 214 having traversed through the bale press 100, the latch gate is now in position to be aligned with the pistons 226 of hydraulic rams 216 (FIG. 2C) to initiate the locking mechanism 212. To effectuate the alignment, the guide receptacle 520 is configured to pivot so that a centerline of the narrow channel 528 is made substantially perpendicular to the front opening door 206 and the rear opening door 208. The pivoting motion may be initiated using a motor, a motor and gear, a pulley assembly, or any pneumatic or hydraulic actuation devices, which can provide the torque required to pivot the latch gate 214 into position. The pivot of the guide receptacle 520 and of the latch gate 214 can be substantially in the same vertical axis. Since the second guide member 506 remains captured within the receptacle guide 520, the pivoting receptacle guide 520 pushes on the second guide member 506 forcing it and the latch gate 214 to which it is mounted to pivot toward the hydraulic rams 216 to align the latch gate 214 therewith.

The movement of the latch gate 214 into the aligned position causes the actuation device 510 coupled at the second end 211 of the latch gate 214 to be activated. For example, in one embodiment, actuation device 510 is a spring type device. Thus, since the spring type device is attached between the rear opening door 208 and the latch gate 214, movement of the latch gate 214 into the aligned position causes the spring to become un-stretched or un-loaded. The spring 510 is therefore configured to rotate the latch gate 214 to a position corresponding to its un-loaded or lowest loaded position which is in the aligned position in its natural state. Once the latch gate 214 is in position, the pistons 226 (FIG. 2C) are activated (extended) to engage the latch gate 214 and lock the doors together as previously described.

To open the doors, the process is reversed. The doors are unlocked by deactivating the pistons 226 (retracted) thus breaking the force against the latch gate 214. A hydraulic or pneumatic cylinder would rotate guide receptacle 520 causing the first end 209 of the latch gate 214 to swing or pivot away from the hydraulic rams 216. Again, since the second guide member 506 is captured within the receptacle guide 520, the latch gate 214 is pivoted to its angled position relative to the rear opening door 208 (see FIG. 2A). The rear opening door 208 may then be pulled open, using for example the opening assembly 300 (FIG. 3), to remove the guide members 504 and 506 from the guide receptacle 520 and consequently remove the latch gate 214 from the bale press 100.

Figure 7:
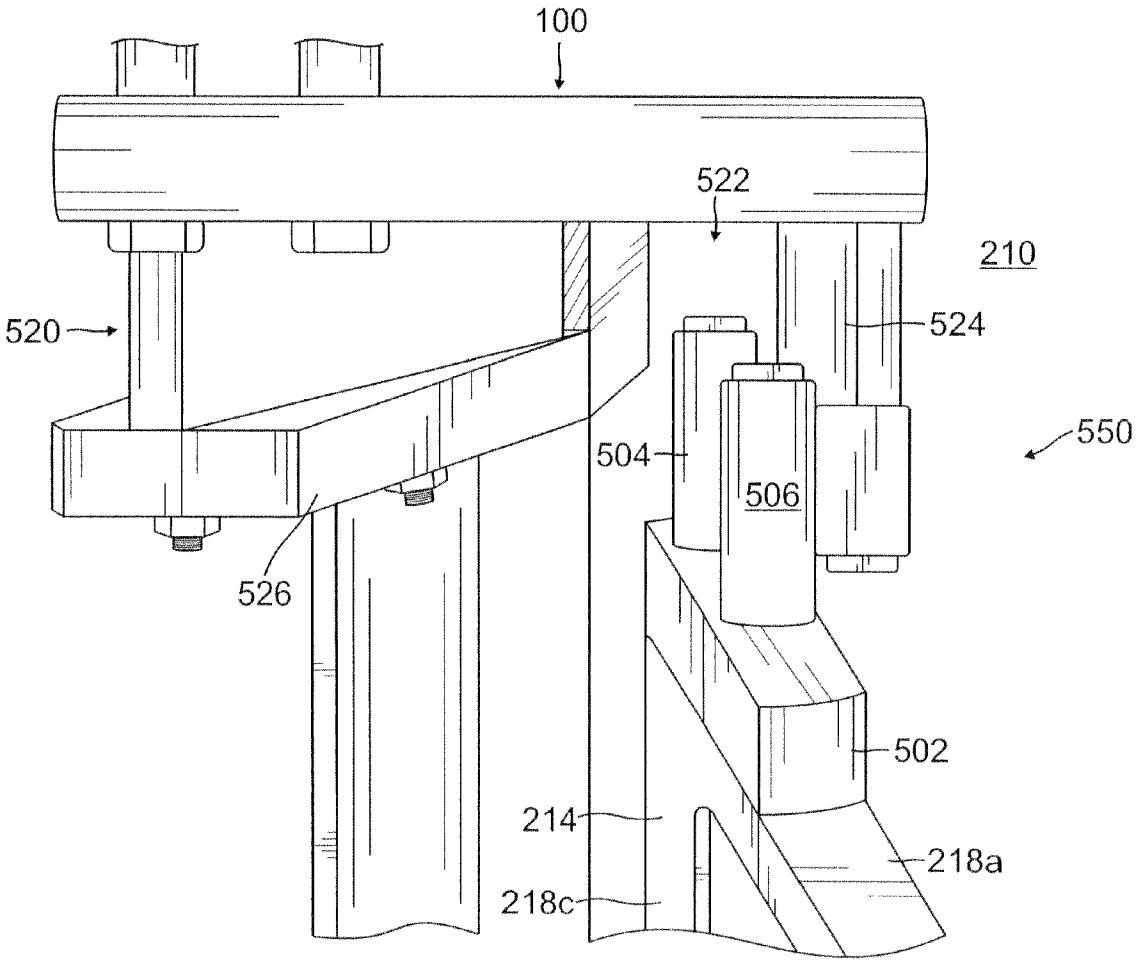
FIG. 7 is a side elevation view of the automated closing assembly of FIG. 6A.

FIG. 7 is a side elevation view of the latch gate 214 moving into the ingress portion 522 of the automated closing assembly 550. In one embodiment, the automated closing assembly 550 comprises a plurality of plates or bars attached to the frame of the bale press 100.

In a feature of the present system, a combination guide members and guide receptacle are used to control the movement of the latch gate. In one example, the guide members are moved into the guide receptacle and the movement is facilitated by an enlarged ingress portion located on the guide receptacle. In another example, when the spring reverses, the spring causes the latch gate to rotate into alignment with an egress portion of the guide channel. The egress portion may embody an enlarged receiving area to facilitate capturing the guide member.

Although embodiments of the opening assembly have been specifically described and illustrated, many modifications, combinations, and variations of the embodiments will be apparent to those skilled in the art. Accordingly, it is to be understood that the illustrated embodiments have been set forth only for the purposes of examples, and that the embodiments should not be taken as limiting the disclosure as defined by the following claims. The following claims are, therefore, to be read to include not only the combination of elements which are literally set forth, but all equivalent elements for performing substantially the same function in substantially the same way to obtain substantially the same result. The claims are thus to be understood to include those that have been illustrated and described above, those that are conceptually equivalent, and those that incorporate the ideas of the present disclosure.

What is claimed is:

1. A door opening assembly for a bale press comprising a first chamber and a second chamber comprising:

a first arm member having a first end, a second end, and hingedly coupled at the first end to a first door to the first chamber;

a second arm member having a first end, a second end, and hingedly coupled at the first end to a second door to the second chamber;

an actuator coupled, either directly or indirectly, to the second end of the first arm member and the second end of the second arm member, wherein activation of the actuator causes at least one of the first arm member and the second arm member to pivot, and the activation of the actuator opens the first door when the second door is locked, and opens the second door when the first door is locked; and wherein the first chamber is separated from the second chamber by at least one wall.

2. The door opening assembly of claim 1, wherein the actuator is coupled to a bale press to facilitate the automatic displacement of the first door.

3. The door opening assembly of claim 1, wherein the actuator is connected to a cross member, which is connected to the first arm member and the second arm member.

4. The door opening assembly of claim 3, wherein the cross member is pivotably connected to the first arm member and the second arm member.

5. The door opening assembly of claim 2, wherein the actuator is pivotably connected to the bale press.

6. The door assembly of claim 1, wherein the first arm member comprises a first beam and a second beam.

7. The door assembly of claim 6, wherein the first beam and the second beam are spaced from one another.

8. A bale press having a movable piston that travels from an upper position to a lower position to press fibrous material into a compressed bale, the bale press comprising:

a housing defining a double box-section, having a first box and a second box; the housing including a first door for the first box and a second door for the second box;

a door opening assembly comprising a first arm member having a first end, a second end, and hingedly coupled at the first end to the first door, a second arm member having a first end, a second end, and hingedly coupled at the first end to the second door, and an actuator coupled, directly or indirectly, to the second end of the first arm member and the second end of the second arm member, and wherein activation of the actuator causes the first arm member to displace the first door or the second arm member to displace the second door.

9. The door opening assembly of claim 8, wherein the actuator is connected to a cross member, which is connected to the first arm member and the second arm member.

10. The door opening assembly of claim 9, wherein the cross member is pivotably connected to the first arm member and the second arm member.

11. The door opening assembly of claim 8, wherein the actuator is pivotably connected to the housing.

12. The door assembly of claim 8, wherein the first arm member comprises a first beam and a second beam.

13. The door assembly of claim 12, wherein the first beam and the second beam are spaced from one another.

14. The door assembly of claim 8, wherein the actuator is a pneumatic cylinder or a hydraulic cylinder having a telescoping rod.

15. A method for opening doors to a bale press having housing comprising a first chamber and a second chamber with a first door and a second door comprising:

connecting a first arm member to the first door, the first arm member having a first end, a second end, and being hingedly coupled at the first end to the first door to the first chamber;

connecting a second arm member to the second door, the second arm member having a first end, a second end, and being hingedly coupled at the first end to the second door to the second chamber;

connecting an actuator, either directly or indirectly, to the second end of the first arm member and the second end of the second arm member and either directly or indirectly to the housing, actuating the actuator to lengthen a rod and causing the first arm member to pivot relative to the actuator, opening the first door when the second door is locked and the actuator to lengthen a rod causing the second arm member to pivot relative to the actuator, opening the second door when the first door is locked; and wherein the first chamber is separated from the second chamber by at least one wall.

16. The method of claim 15, wherein the first arm member pivots when the actuator is actuated to pivot the first door.

17. The method of claim 15, wherein the second arm member pivots when the actuator is actuated to pivot the second door.

18. The method of claim 15, wherein the actuator pivots relative to the housing when actuated.

19. The method of claim 15, wherein the first arm member comprises a first beam and a second beam.

20. The method of claim 19, wherein the first beam and the second beam are spaced from one another.

* * * * *

UNITED STATES PATENT AND TRADEMARK OFFICE

CERTIFICATE OF CORRECTION

PATENT NO. : 8,689,683 B2
APPLICATION NO. : 13/035526
DATED : April 8, 2014
INVENTOR(S) : Bradley P. Actis It is certified that error appears in the above-identified patent and that said Letters Patent is hereby corrected as shown below:

In the Specification

In column 1, line 66, delete “actuator” and insert --actuator is--, therefor.

Signed and Sealed this
Twelfth Day of August, 2014

Michelle K. Lee

Michelle K. Lee
*Deputy Director of the United States Patent and Trademark Office*